US006455133B1

(12) United States Patent
Furukawa et al.

(10) Patent No.: US 6,455,133 B1
(45) Date of Patent: Sep. 24, 2002

(54) INK IMAGING SHEETS

(75) Inventors: Masayoshi Furukawa; Kazuo Notsu, both of Amagasaki (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/304,955

(22) Filed: May 5, 1999

(30) Foreign Application Priority Data

May 11, 1998 (JP) ..... 10-127674

(51) Int. Cl.[7] ..... B41M 5/00
(52) U.S. Cl. ..... 428/195; 428/500; 428/910
(58) Field of Search ..... 428/195, 500, 428/910

(56) References Cited

U.S. PATENT DOCUMENTS 4,483,965 A 11/1984 Ohba et al.
5,457,018 A 10/1995 Sommer et al.
5,932,355 A * 8/1999 Iqbal et al.
6,087,079 A * 7/2000 Newberry et al.

FOREIGN PATENT DOCUMENTS

| | | |
|---|---|---|
| EP | 0501441 A2 | 9/1992 |
| EP | 0654503 A2 | 5/1995 |
| GB | 1295162 | 11/1972 |
| JP | 9226233 | 9/1997 |

* cited by examiner

*Primary Examiner*—Pamela R. Schwartz
(74) *Attorney, Agent, or Firm*—Birch, Stewart, Kolasch & Birch, LLP

(57) ABSTRACT

An ink imaging layer is formed on at least one surface of a base sheet constituted of a stretched styrenic resin sheet to provide an ink imaging sheet. The stretched styrenic resin sheet is tearable. The ink imaging layer comprises at least a hydrophilic polymer and may further contain a particulate lubricant. This ink imaging sheet has improved ink absorption and tearability. It is advantageous as an ink jet printing sheet for overhead projectors.

8 Claims, No Drawings

INK IMAGING SHEETS

FIELD OF THE INVENTION

The present invention relates to a tearable ink imaging sheet and a method for producing the same, particularly to an ink imaging sheet which is excellent in ink absorption, ink fixation and print quality, easy tearable or shreddable by a shredder, and transparent enough to be used as a sheet for an overhead projector (OHP), and to a method for producing the same.

BACKGROUND OF THE INVENTION

The ink jet recording system has been popularized in recent years, because the system is well adaptable to full-color image reproduction, less noisy, and superior in print quality. From the standpoints of safety and recordability, water-based inks are mostly employed for ink jet recording in which droplets of an ink are ejected from a nozzle against a recording sheet for image recording. Therefore, the recording sheet is required to absorb the ink quickly. Thus, when a recording sheet of low ink absorption is used, the ink remains or stays long on the surface of the recording sheet even after completion of ink ejection so that the recorded image is easily smeared and stained on contact with the equipment, with the operator, or with recorded sheets piled on one another. Moreover, in the high-density image area, the ink supplied in a large quantity is not well absorbed but flows out to cause a blurred image.

In recent years, overhead projectors (OHP) that use plastic sheets as recording sheets, as their prices go down and they are downsized, have been introduced into various fields for, for instance, presentations, and many recorded images for use with OHPs have been simply formed using inkjet printers and the like. When images are re-corded on plastic sheets, the images suffer from being smeared and blurred on contact, even after the ink have been absorbed. Therefore, the sheets are required to have not only quick ink absorption but also a high ink fixing property.

Moreover, such plastic sheets (especially, sheets for OHPS) are required to have high transparency because of the necessity of light transmission. Besides, they are also required to be good in handling enough not to stick or block to each other even when piled on one after another, regardless of before being recorded or after having been recorded.

On the other hand, as recording methods, recording mediums, or recording materials has largely been improved and, consequently, high quality and low-priced printing devices has become available and easy-affordable, a large amount of recorded sheets are produced, thus raising the problem of disposal. Particularly, when discarding highly confidential recorded sheets, generally, cutting machines such as shredders are used. When using a shredder, good cutting quality can be expected if a recording material is one that is relatively easy to shred, such as paper. On the other hand, recorded matters of plastic sheets are inferior in cuttability to paper, and it is costly to discard them. Particularly, when inserted into a shredder in the form of a sheet, the sheet is jammed and therefore can not be shredded.

Moreover, as OHP sheets, sheets of polyester resin (e.g., polyethylene terephthalate) are usually used. However, since such sheets are tough themselves, it is difficult to cut them by hand or a machine.

Japanese Patent Application Laid-open No. 226233/1997 (JP-A-9-226233) discloses polyesters and polystyrenes as bases or supports and a process for producing an ink jet recording sheet by forming an ink absorbable layer on at least one side of such base.

SUMMARY OF THE INVENTION

It is, therefore, an object of the present invention to provide tearable ink imaging sheets with high ink absorption and ink fixing property, and a method for producing the same.

It is another object of the present invention to provide ink imaging sheets that are highly transparent and inhibited from being stuck to each other even if they are stacked up one after another, and a method for producing the same.

The inventors of the present invention found that ink absorption, ink fixation and print quality of the ink imaging sheet can be improved by forming an ink imaging layer on at least one surface of a stretched styrenic resin sheet, with high transparency being maintained and largely improved tearability. The present invention was accom-plished based on the above findings.

Thus, the ink imaging sheet of the present invention is a sheet comprising an ink imaging layer formed on at least one surface of a base sheet, and the base sheet is constituted of a stretched styrenic resin sheet. The stretched styrenic resin sheet is tearable in longitudinal, lateral, and diagonal directions. The ink imaging layer may contain a hydrophilic polymer. The ink imaging layer may further comprise a particulate lubricant.

The present invention also includes a method for producing an ink imaging sheet which comprises forming the imaging layer on at least one surface of a stretched styrenic resin sheet.

In this specification, the term "hydrophilic polymer" means various polymers having an affinity for water, and includes absorbable polymers and water-soluble polymers. Moreover, in the specification, acrylic mono-mers and methacrylic monomers are generally referred to as (meth)acrylic monomer.

DETAILED DESCRIPTION OF THE INVENTION

The ink imaging sheet (i.e., a sheet for forming an ink-image) of the present invention comprises a base sheet and an ink imaging layer, and the base sheet is constituted of a stretched (or oriented) styrenic resin sheet. Such ink imaging sheet is useful as an ink jet recording sheet against which droplets of an ink are ejected for forming an ink image.

Base Sheet

Depending on the intended use, a stretched styrenic resin sheet for an ink imaging sheet may be opaque, semitransparent, translucent, or transparent, provided that its tearability is not adversely affected. The sheet is usually transparent when used for an overhead projector (OHP).

A styrenic resin constituting the styrenic resin sheet may be a homopolymer of an aromatic vinyl compound or a copolymer thereof, or a copolymer of an aromatic vinyl compound and a copolymerizable vinyl monomer.

As the aromatic vinyl compound, there may be mentioned, for example, styrene, alkylstyrenes (e.g., vinyltoluenes such as o-, m-, and p-methylstyrenes; p-ethylstyrene, p-isopropylstyrene, butylstyrene, p-t-butylstyrene), α-alkylstyrenes (e.g., α-methylstyrene), and halostyrenes (e.g., o-, m-, and p-chlorostyrene, p-bromostyrene). These aromatic vinyl monomers can be used independently or as a combination of two or more species. Styrene, vinyltoluenes, α-methylstyrene are preferred as the styrenic monomer, and particularly preferred are styrene.

As the copolymerizable vinyl monomers, there may be mentioned, e.g., (meth)acrylonitrile, alkyl (meth)acrylates, vinyl ester-series monomers (e.g., vinyl acetate), hydroxyl group-containing monomers [hy-droxyl-$C_{1-4}$alkyl (meth) acrylate such as hydroxylethyl (meth)acrylate, hydroxypropyl (meth)acrylate], glycidyl group-containing monomers [e.g., glycidyl (meth)acrylate], carboxyl group-containing monomers [e.g., methacrylic acid, maleic anhydride, fumaric acid], and imide-monomers (e.g., maleimide, N-methylmaleimide, N-phenylmaleimide). The alkyl (meth) acrylates include $C_{1-20}$alkyl (meth)acrylates such as methy (meth)acrylate, ethyl (meth)acrylate, butyl (meth)acrylate, t-butyl (meth)acrylate, hexyl (meth)acrylate, octyl (meth) acrylate, 2-ethylhexyl (meth)acrylate, and lauryl (meth) acrylate. These vinyl monomers can be used independently or as a combination of two or more species.

As a styrenic resin having high transparency, there may be mentioned, e.g., polystyrene, acrylonitrile-styrene copolymer (AS resin), styrene-(meth)acrylic acid copolymer, styrene-maleic anhydride copolymer, sty-rene-(meth) acrylate copolymers (e.g., styrene-methyl methacrylate copoymer), styrene-(meth)acrylate-(meth)acrylic acid copolymers (e.g., styrene-methyl methacrylate-(meth) acrylic acid copolymer), and styrene-(meth)acrylate-maleic anhydride copolymers (e.g., styrene-methyl methacrylate-maleic anhydride compoymer).

For the copolymers, the form thereof is not particularly restricted, and may be random copolymers, block copolymers, tapered block copolymers, or graft copolymers. These styrenic resins can be used independently or as a combination of two or more species.

To provide or improve various properties such as heat resistance, low temperature resistance, impact resistance, flame retardancy, and moldability, to the styrenic resins may be added, if needed, various additives such as stabilizers (e.g., ultraviolet ray absorbers, antioxidants), plasticizers, fillers, slipping agents, antiblocking agents, nuclear agents, crosslinking agents, antistatic agents, flame retardants, shielding agents such as titanium oxides, colorants, or mineral oils.

The base sheet can be obtained by molding the styrenic resin in the form of a sheet or film according to a conventional method. The base sheet is a stretched sheet (a uniaxially oriented sheet or biaxially oriented sheet). As a method for making the sheet (uniaxial stretching method, biaxial stretching method), there may be exemplified extrusion methods (e.g., T-die molding, inflation molding), and as a stretching method, there may be mentioned a tainter method, a tube method, and an inflater method.

The base sheet is stretched, in at least one direction of the longitudinal and lateral directions, to about 1 to 3 times, preferably about 1 to 2.5 times (e.g., 1 to 2 times), and usually to about 1.5 to 2 times its original lengths.

The sheet may be a sheet comprising a single layer, a laminated sheet comprising a plurality of layers of styrenic resins each having a different composition, or a laminated sheet comprising a layer of a styrenic resin and a layer of other resin (e.g., olefinic resins such as polyethylene, polypropylene).

Since the base sheet is constituted of a stretched styrenic resin sheet, it can be torn in a desired or optional direction, e.g., in the longitudinal, lateral, or diagonal direction.

The tearing strength of the base sheet is about 0.05 to 0.25 Kgf/mm, preferably about 0.08 to 0.2 Kgf/mm (e.g., 0.1 to 0.2 Kgf/mm), and usually about 0.1 to 0.16 Kgf /mm, according to JIS K7128 (tearability-testing method for plastic films and sheets). When defining the tearing strength of a polyethylene terephthalate film having 100 μm thickness (a film heat-treated at 110° C. for 3 minutes) and that of the base sheet of the present invention having 130 μm thickness (stretched styrenic resin sheet) as $S_{PET}$ and $S_{ST}$, respectively, the ratio $S_{ST}/S_{PET}$=about 0.01/1 to 0.7/1, preferably about 0.05/1 to 0.5/1 (e.g., 0.05/1 to 0.4/1), and more preferably about 0.1/1 to 0.3/1. The base sheet having the ink imaging layer formed thereon has substantially the same tearing strength and ratio as the base sheet described above.

The thickness of the base sheet can be suitably selected, depending on its intended use, and is usually about 30 to 500 μm, and preferably about 40to 250 μm (e.g., 50 to 200 μm). The thickness of a film for OHPs is usually about 30 to 200 m (e.g., 50 to 150 μm).

Moreover, to improve the adhesion of the base sheet to an ink imaging layer or an adhesive—these will be described below—the base sheet may be subjected to surface treatment such as corona discharge treatment or undercoat treatment. Corona discharge treatment forms reactive groups (e.g., hydroxyl group, carboxyl group) over the surface of the base sheet and thus the use of a cationic polymer having a reactive group (especially, alkoxysilyl group) as a component for an imaging layer, which will be described later, causes the reaction between the reactive groups on the base sheet and those of the imaging layer and, consequently, results in a significant improvement in the adhesion between the base sheet and the ink imaging layer.

Since the base sheet constituting the ink imaging sheet of the present invention is constituted of a stretched styrenic resin sheet, the total light transmittance of the sheet is as high as about 88 to 97% (e.g., 90 to 95%) and therefore is useful as an OHP sheet which is required to be highly transparent.

Ink Imaging Layer

The ink imaging sheet of the present invention comprises an ink imaging layer formed on at least one surface of the base sheet. The ink imaging layer (ink-receiving layer) may be formed with an organic or an inorganic material, and it is preferable that the ink imaging layer contains at least a hydrophilic polymer. The ink absorption and ink fixation of the ink imaging layer can be further improved by incorporating a cationic polymer (preferably, a cationic emulsion containing a cationic polymer) into the ink imaging layer.

Hydrophilic Polymer

As the hydrophilic polymers, there may be exemplified hydrophilic naturally-occurring polymers and derivatives thereof (e.g., starch, corn starch, sodium alginate, gum arabic, gelatin, casein, dextrin), cellulose derivatives (e.g., methylcellulose, ethylcellulose, hydroxyethylcellulose, carboxymethylcellulose, cellulose sulfate, cyanoethylcellulose), vinyl alcohol-series polymers (e.g., polyvinyl alcohol, ethylene-vinyl alcohol copolymer), ethylenic polymers (e.g., ethylene-maleic anhydride copolymer), vinyl acetate-series copolymers (e.g., vinyl acetate-methyl acrylate copolymer), polyalkylene oxides, carboxyl- or sulfo-containing polymers and salts thereof [e.g., acrylic polymers (poly(meth)acrylic acid or its salt (alkaline metal salts such as ammonium and sodium), methyl methacrylate-(meth)acrylic acid copolymer, acrylic acid-polyvinyl alcohol copolymer), vinyl ether-series polymers (polyvinyl alkyl ethers such as polyvinyl methyl ether and polyvinyl isobutyl ether, and methyl vinyl ether-maleic anhydride copolymer), styrenic polymers (e.g., styrene-maleic anydride copolymer, styrene-(meth)acrylic acid copolymer, poly(sodium styrenesulfonate), poly(sodium vinyl sulfonate)], nitrogen-containing polymers (or cationic polymers) and salts thereof (quaternary ammonium salts such as polyvinylbenzyltri-methylammonium chloride, polydiallyldimethylammonium chloride, etc., polydimethylaminoethyl (meth)acrylate hydrochloride, polyvinylpyridine, polyvinylimidazole, polyethyleneimine, polyamidepolyamine, polyacrylamide and polyvinylpyrrolidone]. These hydrophilic polymers can be used independently or in combination.

Among these hydrophilic polymers, those preferred are cellulose derivatives (particularly hydroxyethylcellulose, etc.), vinyl alcohol-series polymers (particularly polyvinyl alcohol, etc.), vinyl ester-series polymers (particularly vinyl acetate-series copolymers etc.), polyvinylpyrrolidone, and the like.

Moreover, as will be described below, also preferred are hydrophilic polymers each having at least one functional group selected from (1) polyoxyalkylene unit, (2) acetoacetyl group, (3) carboxyl group, (4) acid anhydride group, and (5) amino group.

The above-mentioned vinyl ester-series polymers (e.g., vinyl acetate-series copolymers) are copolymers of a vinyl ester (e.g., vinyl acetate) with another species of copolymerizable monomer and include partially saponified products thereof (e.g., partially saponified products with degrees of saponification of about 10 to 90%). The preferred copolymerizable monomer includes hydro-philic monomers having a hydrophilic group (e.g., carboxyl and sulfo, inclusive of their salts, hydroxyl group, and ether groups). Particularly, use can be made of a vinyl monomer having an ether group, particularly a vinyl monomer having an oxy$C_{2-4}$alkylene unit. For example, (meth)acrylic acid ester and allyl ethers with the number of alkylene oxide units (number of moles added) of about 1 to 100, preferably about 2 to 80 (e.g., 5 to 80), and more preferably about 5 to 70 (e.g., 10 to 50) are available.

Among (1) the hydrophilic polymers having a polyoxyalkylene unit, the preferred monomers having an oxyalkylene unit include vinyl monomers (e.g., (meth)acrylates) containing an oxyethylene unit as an oxyalkylene unit, and preferably polyoxyalkylene (meth)allyl ethers (particularly, polyoxyethylene allyl ethers).

In the vinyl acetate-series copolymer, the proportion of the copolymerizable monomer can be selected from the range not adversely affecting image definition (image sharpness), and may for example be about 0.1 to 50 mole%, preferably about 1 to 30 mole%, and more preferably about 2.5 to 25 mole% (e.g., 3 to 20 mole%) of the total monomer component.

The copolymer of vinyl acetate with a vinyl monomer having a polyoxyalkylene unit (modified-vinyl acetate-series resin) is commercially available under the trade name of OKS-7158G, product of Nippon Synthetic Chemical Industry, Co., Ltd., to give an example.

(2) The acetoacetyl group-containing hydrophilic polymer (acetoacetyl group-modified hydrophilic polymer) includes hydrophilic polymers obtainable by the reaction of a hydroxyl group-containing hydrophilic polymer with an acetoacetic acid ester, such as acetoacetyl group-modified vinyl acetate-series copolymers (acetoacetyl group-containing polyvinyl alcohol, acetoacetyl group-containing cellulose derivatives, etc.). Acetoacetyl group-modified vinyl acetate-series copolymers are available from, for example, Nippon Synthetic Chemical Industry Co., Ltd.

(3) Carboxyl group-containing hydrophilic poly-mers (carboxyl group-modified hydrophilic polymer)

(3a) Carboxyl group-modified polyvinyl alcohols, e.g., partial hydrolyzates of the copolymers of a vinyl ester (vinyl acetate, vinyl propionate, vinyl formate, etc.) with a carboxyl group-containing unsaturated monomer (a monocarboxylic acid such as (meth)acrylic acid, a dicarboxylic acid such as maleic acid, fumaric acid and itaconic acid, or an acid anhydride or alkyl monoester thereof, etc.). Such carboxyl group-modified polyvinyl alcohols are available from, for example, Kuraray Co., Ltd.

The carboxyl group-modified hydrophilic polymer further includes styrene-(meth)acrylic acid copolymer, (meth) acrylic acid ester-(meth)acrylic acid copolymer (e.g., methyl methacrylate-(meth)acrylic acid copolymer), vinyl acetate-(meth)acrylic acid copolymer, and the like.

(3b) Carboxyl group-containing polysaccharides such as carboxy $C_{1-4}$ alkylcellulose, carboxymethyldextran, and alginic acid.

(4) Acid anhydride group-containing hydrophilic polymers

Alkyl vinyl ether-maleic anhydride copolymers (e.g., methyl vinyl ether-maleic anhydride copolymer), ethylene-maleic anhydride copolymer, vinyl acetate-maleic anhydride copolymer, styrene-maleic anhydride copolymer, and (meth) acrylic acid ester-maleic anhydride copolymers (e.g., methyl methacrylate-maleic anhydride copolymer).

(5) Amino group-containing hydrophilic polymer

Polyamide-polyamines, polyvinylamines, partial hydrolyzates of poly(N-vinylformamide), and amino group-containing polysaccharides (aminodextran, chitosan, etc.).

A preferred ink imaging layer may comprise a cationic polymer and the hydrophilic polymer. Even an ink imaging sheet of such composition shows high ink absorption.

Cationic Polymer

The cationic monomer for the cationic polymer includes not only a variety of monomers each having a tertiary amino group or a salt thereof, but also a variety of monomers each having, or capable of forming, a quaternary ammonium base.

As the cationic monomer, there may exemplified acrylic monomers such as di-$C_{1-4}$alkylamino-$C_{2-3}$alkyl (meth) acrylamides or salts thereof [e.g., dimeth-ylaminoethy (meth)acrylamide, diethylamino-ethy(meth) acrylamide, dimethyaminopro-pyl (meth) acrylamide, diethylaminopropyl (meth) acrylamide, and salts thereof], di-$C_{1-4}$alkylamino-$C_{2-3}$alkyl (meth)acrylates and salts thereof [e.g., dimethyamino-ethyl (meth)acrylate, diethylaminoethyl (meth)acrylate, dimethylaminopropyl (meth)acrylate, diethylaminopropyl (meth)acrylte, and salts thereof]; di-$C_{1-4}$alkylamino-$C_{2-3}$alkyl group-substituted aromatic vinyl compounds and salts thereof [e.g., 4-(2-dimethylaminoethyl)styrene, 4-(2-dimethylaminopropyl) styrene, and salts thereof]; and nitrogen-containing heterocyclic monomers and salts thereof [e.g., vinylpyridine, vinylimidazole, vinylpyrrolidone, and salts thereof]. The salts mentioned above include halogenated hydroacid salts (e.g., hydro-chloride, hydrobromide), sulfates, alkylsulfates (e.g., methylsulfate, ethylsulfate), alkylsulfonates, arylsulfonates, and carboxylates (e.g., acetate). An alkylating agent (e.g., epichlorohydrin, methyl chloride, benzyl chloride) may be permitted to act upon the tertiary amino group to form a quaternary ammonium base.

The cationic polymer may contain a crosslinking group. The cationic polymer containing a crosslinking group may be a polymer of monomers, comprising a cationic monomer and either or both of a crosslinking monomer and a hydrophilic monomer but a least the crosslinking monomer. The preferred cationic polymer is a polymer of monomers, comprising at least a cationic monomer, crosslinking monomer and hydrophilic monomer.

The crosslinking monomer includes various self-crosslinking monomers (self-crosslinkable monomers) and monomers having a reactive functional group, such as epoxy group-containing monomers [glycidyl (meth)acrylate, (meth)allyl glycidyl ether, 1-allyloxy-3,4-epoxybutane, 1-(3-butenyloxy)-2,3-epoxypropane, 4-vinyl-1-cyclohexene-1,2-epoxide], methylol group-containing monomers and derivatives thereof [e.g., N-methylol (meth) acrylamide, N-$C_{1-4}$ alkoxymethyl(meth)acrylamide such as N-methoxymethyl(meth)acrylamide, N-butylol (meth) acrylamide], silyl or other hydrolytic-condensing group-containing monomers [e.g., vinyltrimethoxysilane, vinyltriethoxysilane, vinyltributoxysilane, vinylmethoxydimethylsilane, vinylethoxydimethylsilane, vinylisobutoxydimethylsilane, vinyldimethoxymethylsilane, vinyldiethoxymethylsilane, vinyltris(β-methoxyethoxy) silane, vinyldiphenylethoxysilane, vinyl-triphenoxysilane, γ-(vinylphenylaminopropyl)trimethoxysilane, γ-(vinylbenzylaminopropyl)trimethoxysilane, γ-(vinylphenylaminopropyl)triethoxysilane, γ-(vinylbenzylaminopropyl)triethoxysilane, divinyldimethoxysilane, divinyldiethoxysilane, divinyldi(β-methoxyethoxy)silane, vinyldiacetoxymethylsilane, vinyltriacetoxysilane, vinyl-bis (dimethylamino) methylsilane, vinylmethyldichlorosi-lane, vinyldimethylchlorosilane, vinyltrichlorosilane, vinylmethylphenylchlorosilane, allyltriethoxysilane, 3-allylaminopropyltrimethoxysilane, allyldiacetoxymethylsilane, allyltriacetoxysilane, allyl-bis (dimethylamino) methylsilane, allylmethyldichlorosi-lane, allyldimethylchlorosilane, allyltrichlorosilane, methallylphenyldichlorosilane, β-(meth) acryloxyethyltrimethoxysilane, β-(meth) acryloxyethyltriethoxysilane, γ-(meth) acryloxypropyltrimethoxysilane, γ-(meth) acryloxypropyltriethoxysilane], γ-(meth) acryloxypropylmethyldimethoxysilane, γ-(meth) acryloxypropylmethyldichlorosilane, γ-(meth) acryloxypropyltris (β-methoxyethoxy)silane], and aziridinyl group-containing monomers [e.g., 2-(1-aziridinyl) ethyl (meth) acrylate, 2-(1-aziridinyl)propyl (meth)acrylate, 3-(1-aziridinyl)propyl (meth)acrylate]. Those crosslinking monomers can be used singly or in a combination of two or more species.

The preferred crosslinking monomer includes those having a hydrolytic-condensing group, particularly an alkoxysilyl group ($C_{1-4}$alkoxysilyl groups such as meth-oxysilyl group and ethoxysilyl).

The hydrophilic monomer includes hydrophilic group-containing copolymerizable monomers, for example, carboxyl group-containing monomers [monomers having a free carboxyl group or an acid anhydride group, such as (meth) acrylic acid, itaconic acid, maleic acid, maleic anhydride, fumaric acid and crotonic acid, and the salts thereof (alkali matal salts, alkaline earth metal salts, ammonium salts, amine salts, etc.)], half-esters of an unsaturated polycarboxylic acid or anhydride thereof with a straight- or branched-chain alcohol containing about 1 to 20 carbon atoms [monomethyl maleate, monoethyl maleate, monobutyl maleate, monooctyl maleate, mono-2-ethylhexyl maleate, etc.], hydroxyl group-containing monomers [hydroxy $C_{2-6}$ alkyl esters of (meth)acrylic acid, such as 2-hydroxyethyl (meth)acrylate, 2-hydroxypropyl (meth) acrylate, 3-hydroxypropyl (meth)acrylate and 4-hydroxybutyl (meth)acrylate, etc.], amide group-containing monomers [(meth)acrylamide, α-ethyl (meth) acrylamide, N-methyl(meth)acrylamide, N-butoxymethyl (meth) acrylamide, diacetone (meth) acrylamide, etc.], sulfo-containing monomers [styrenesulfonic acid, vinylsulfonic acid, etc.], ether group-containing mono-mers [vinyl ethers such as vinyl methyl ether, vinyl ethyl ether and vinyl isobutyl ether], and polyoxyalkylene group-containing monomers [diethylene glycol mono(meth)acrylate, triethylene glycol mono(meth)acrylate, polyethylene glycol mono (meth)acrylate, etc.]. These hydrophilic monomers may also be used independently or in a combination of two or more species.

The preferred hydrophilic monomer includes car-boxyl group-containing monomers [e.g., (meth)acrylic acid and its salts (e.g., sodium salts, potassium salts], hydroxyl group-containing monomers [2-hydroxyethyl (meth) acrylate, hydroxypropyl (meth) acrylate, etc.], and monomers containing a polyoxyalkylene unit [diethylene glycol mono (meth)acrylate, triethylene glycol mono(meth)acrylate, polyethylene glycol mono(meth)acrylate, etc.].

These monomers are generally used in combination with one or more nonionic monomers for judicious control of film-forming properties and coating characteristics.

The nonionic monomer that can be used includes, for example, alkyl esters [e.g., $C_{1-18}$alkyl esters of (meth)acrylic acid such as methyl (meth)acrylate, ethyl (meth)acrylate, propyl (meth)acrylate, isopropyl (meth)acrylate, n-buthyl (meth)acrylate, isobutyl (meth)acrylate, t-butyl (meth) acrylate, hexyl (meth)acrylate, octyl (meth)acrylate, 2-ethylhexl (meth)acrylate, lauryl (meth)acrylate and stearyl (meth)acrylate], cycloalkyl esters [cyclohexyl (meth) acrylate, etc.], aryl esters [phenyl (meth)acrylate, etc.], aralkyl esters [benzyl (meth)acrylate, etc.], aromatic vinyl compounds [styrene, vinyltoluene, α-methylstyrene, etc.], vinyl esters [vinyl acetate, vinyl propionate, vinyl versatate, etc.], allyl esters [allyl acetate, etc.], halogen-containing monomers [vinylidene chloride, vinyl chloride, etc.], vinyl cyanides [(meth)acrylonitrile, etc.], olefins [ethylene, propylene, etc.], and the like.

These nonionic monomers can also be used independently or in a combination of two or more species.

As the nonionic monomer, use can be generally made of $C_{1-18}$alkyl esters of (meth)acrylic acid [particularly $C_{2-10}$alkyl esters of acrylic acid and $C_{1-6}$alkyl esters of methacrylic acid], aromatic vinyl compounds [particularly styrene], and vinyl esters [particularly viny acetate].

The proportions of the cationic monomer, crosslinkable (crosslinking) monomer, and hydrophilic monomer can be judiciously selected from the range not detracting from ink absorption and ink fixation. To give an example, the cationic monomer may account for about 0.1 to 50 mole % (e.g., 1 to 45 mole %), preferably about 0.5 to 40 mole % (e.g., 2 to 35 mole %), more preferably about 1 to 30 mole % (e.g., 3 to 25 mole %), and usually about 2 to 25 mole %, of the total monomer component. The crosslinking monomer may account for about 0.1 to 25 mole %, preferably about 0.2 to 20 mole A, more preferably about 0.5 to 15 mole %, and usually about 0.3 to 10 mole %, of the total monomer component.

The proportion of the hydrophilic monomer may for example be about 0 to 50 mole %, preferably about 0 to 45 mole % (0.5 to 45 mole %), more preferably about 0 to 40 mole % (1 to 35 mole %), and generally about 1 to 20 mole % of the total monomer component. Usually, the nonionic monomer mentioned above accounts for the remainder of the total monomer component.

The proportion of each monomer relative to 100 parts by weight of the cationic monomer is as follows:

Crosslinkable monomer: about 1 to 50 parts by weight, preferably about 5 to 20 parts by weight, Hydrophilic monomer: about 0 to 300 parts by weight, preferably about 10 to 200 parts by weight, and Nonionic monomer: about 100 to 1,000 parts by weight, preferably about 150 to 500 parts by weight.

The glass transition temperature of the cationic polymer can be selected from the range not adversely affecting film-forming property (film-formability) and other characteristics, and may for example be about −20° C. to 50° C., preferably about −10° C. to 40° C., and more preferably about 0° C. to 30° C., as measured at a temperature rise rate of 20° C. per minute with the Differential Scanning Calorimetor (DSC). Polymers having a glass transition temperature within such range can be produced by using the above-mentioned cationic monomer, crosslinkable monomer and, if needed, the above-mentioned hydrophilic monomer and/or nonionic monomer, in a suitable combination.

These monomers may practically be copolymerized with a nonionic monomer such as a hard monomer [e.g., a monomer which will give a homopolymer with a glass transition temperature of about 80 to 120° C. (particularly 90 to 105°), such as methyl (meth)acrylate and styrene] and a soft monomer [e.g., a monomer which will give a homopolymer with a glass transition temperature of about −85° C. to −10° C. (particularly about −85° C. to −20° C.), such as $C_{2-10}$alkyl esters of acrylic acid] to constitute a copolymer.

The ratio of the hard monomer to the soft monomer (the former/the latter) is, for example, about 5/95 to 95/5 (weight ratio), preferably about 20/80 to 80/20 (weight ratio), and more preferably about 30/70 to 70/30 (e.g., 40/60 to 60/40) (weight ratio).

When using such monomers in combination, the proportion of each monomer can be selected, e.g., from within the following range.

(a) Cationic monomer:

1 to 40 weight % (preferably 3 to 35 weight %, particularly 5 to 30 weight %)

(b) Crosslinking monomer:

0.5 to 20 weight % (preferably 1 to 15 weight %, particularly 2 to 10 weight %)

(c) Hydrophilic monomer:

0 to 50 weight % (preferably 2 to 45 weight %, particularly 5 to 40 weight %)

(d) Hard monomer 10 to 60 weight % (preferably 20 to 55 weight %, particularly 25 to 50 weight %)

(e) Soft monomer 10 to 60 weight % (preferably 15 to 50 weight %, particularly 20 to 45 weight %).

The mean particle size of the polymer particles in a cationic emulsion is, for example, about 1 to 200 nm, preferably about 3 to 100 nm, and more preferably about 5 to 50 nm.

The cationic emulsion containing such cationic polymer can be prepared according to the conventional method, such as the method in which the above-mentioned monomers are emulsion-polymerized in an emulsion polymerization system containing a nonionic surfactant and/or a cationic surfactant and the method in which, following the polymerization of the monomers, the reaction product is converted to a tertiary amine salt or a quaternary ammonium salt to provide the objective aqueous emulsion.

According to the reactive functional group of the cationic polymer (e.g., epoxy groups such as glycidyl group, alkoxysilyl groups), from the above-mentioned hydrophilic polymers may be selected an appropriate hydrophilic polymer having a functional group reactive thereto. Such hydrophilic polymer can be used, for example, in the following combinations, according to the species of the of the reactive group (particularly crosslinking group) of the cationic polymer.

(1) Cationic polymer: epoxy groups such as gly-cidyl group
Hydrophilic polymer: carboxyl group, acid anhydride groups, amino group (2) Cationic polymer: methylol group
Hydrophilic polymer: hydroxyl group, carboxyl group, acid anhydride groups (3) Cationic polymer: hydrolytic-condensing group such as alkoxysilane group
Hydrophilic polymer: hydroxyl group, carboxyl group (4) Cationic polymer: aziridinyl group
Hydrophilic polymer: hydroxyl group, carboxyl group, amino group In such combinations, the cationic polymer and the hydrophilic polymer bond to or crosslink with each other to form an ink imaging layer of high ink absorption, ink fixation, and print quality.

The preferred hydrophilic polymer reactive to the cationic polymer includes hydrophilic polymers which are self-crosslinkable and contain a functional group reactive to the reactive functional group of the cationic polymer, for example, the aforementioned hydrophilic polymers such as acetoacetyl group-modified hydrophilic polymers, carboxyl group-modified hydrophilic polymers, acid anhydride group-containing hydrophilic polymers, and amino group-containing hydrophilic polymer.

The ratio of the cationic polymer to the hydro-philic polymer can be selected, according to the species of the cationic polymer and the hydrophilic polymer and the concentration of the crosslinkable (or crosslinking) group, from the range not detracting from ink absorption or ink fixation. For example, the ratio (former/latter) can be selected from the range of about 5/95 to 95/5 (weight %), preferably about 10/90 to 90/10 (weight %), and more preferably about 20/80 to 80/20 (weight %), on a nonvolatile matter basis. The ratio is usually about 10/90 to 50/50 (weight %), and particularly about 20/80 to 40/60 (weight %).

Conversely, the hydrophilic polymer itself may have a reactive group reactive to the reactive functional group of the cationic polymer. For example, when the hydrophilic polymer is an epoxy-containing polymer, the cationic polymer may have a carboxyl or amino group. The epoxy group-containing polymer includes, for example, hydrolyzates of the copolymers of an epoxy group-containing monomer (glycidyl (meth)acrylate, allyl gly-cidyl ether, etc.) with a vinyl ester (vinyl acetate, etc.),epoxy group-containing polyvinyl alcohols obtainable by a reaction of a hydrophilic polymer containing an active hydrogen atom (e.g., hydroxyl group, amino group, carboxyl group) with epichlorohydrin, and epoxy group-containing polyvinylpyrrolidones obtainable by copolymerizing the epoxy group-containing monomer with vinylprrolidone. The epoxy content is about 0.01 to 5 mole %, preferably about 0. 1 to 3 mole % (e.g., 0.2 to 2.5 mole%), and particularly about 0.2 to 2 mole %, based on the total monomer component.

In the ink imaging layer may be incorporated a particulate lubricant. By incorporating a particulate lubricant, blocking is prevented, and the sheet is rendered more slippery. Moreover, incompleteness of the image on the sheet caused by contact after being printed is precluded, and the sheet is writable thereon. Furthermore, even if ink imaging sheets are stacked, the sheets don's t stick to each other.

Lubricants

As the lubricant, for example, there can be used, for example, an inorganic or organic particulate or powdery lubricant. As the inorganic lubricant, there may be exemplified silica, alumina, the powder of quartz, glass beads, powdered glass, calcium silicate, aluminum silicate, almino-silicate magnesium, kaolin, clay, talc, diato-maceous earth, wollastonite, calcined diatomaceous earth; particulate minerals such as sericite; finely divided carbonaeous substances such as white carbon; metal oxides such as zinc oxide, titanium oxides, magnesium oxide, calcium oxide, and barium oxide; metal carbonates such as calcium carbonate, magnesium carbonate, barium carbonate, and zinc carbonate; metal sulfates such as magnesium sulfate, calcium sulfate, and barium sulfate; metal hy-droxides such as aluminium hydroxide, calcium hydroxide, and magnesium hydroxide; and zeolites (e.g., synthetic zeolites).

When producing OHP sheets that are required to be highly transparent, an organic lubricant is preferable. As the organic lubricant, there may be mentioned, for example, microfine crosslinkable or non-crosslinkable organic powders of amino resins, polyethylene resin, polystyrene resin, acrylic resins [e.g., (meth)acrylic acid esters such as methyl methacrylate], ureic, melamine, polyamide, benzoguanamine, silicone, fluorine-containing, and other resins, and organic powders such as microfine hollow powders. These powders can be used independently or in a suitable combination of two or more species.

The configuration or shape of the powdery or particulate lubricant is not particularly limited and may be spherical, polygonal, or undefined shape.

The mean particle size of the lubricant can be selected according to the intended use of the sheet, and when producing ink imaging sheets of high transparency, it is about 0.1 to 50 $\mu$m, preferably about 0.2 to 50 $\mu$m (e.g., 0.25to 40 $\mu$m), and usually about 0.25 to 30 $\mu$m (e.g., 0.25 to 25 $\mu$m).

The amount of the particulate or powdery lubricant is about 0.1 to 10 parts by weight (0.2 to 8parts by weight), and preferably about 0.5 to 5 parts by weight (e.g., 0.5 to 2 parts by weight), relative to 100 parts by weight of the total amount of the constituting components. When the amount of the particulate lubricant is less than 0.1 part by weight, an anti-blocking property can not be much improved, and the amount exceeding 10 parts by weight tends to results in degradation of the strength of the ink imaging layer.

The use of the lubricant in combination with an alkoxysilyl group-containing polymer (cationic polymer constituted of an alkoxysilyl group-containing crosslinking monomer) as the cationic polymer enhances the bonding strength between the lubricant and the polymer in consequence of the reactivity of the alkoxysilyl group, and, therefore, particles of the lubricant are effectively prevented from coming off. The proportion of the lubricant is about 10 to 150 parts by weight, preferably about 20 to 120 parts by weight, and more preferably about 40 to 100 parts by weight, relative to 100 parts by weight of the alkoxysilyl group-containing polymer (on a monomer basis).

To accelerate the curing reaction, a curing agent (e.g., a curing catalyst or a curing accelerator) may be added. As the curing agent, there may be exemplified organotin compounds, organoaluminium compounds, organotitanium compounds, organozirconium compounds, acid compounds, acid phosphate esters, and mixtures or reaction products of the acid phosphate ester and an amine. Those exemplified above can be used singly or in a combination of two or more species.

The amount of the curing agent is in a range within which better, accelerated curing performance can be expected, e.g., about 0.01 to 10 parts by weight and preferably about 0.1 to 5 parts by weight on a solid basis, per 100 parts by weight of the hydrophilic polymer.

To improve the fixation of a colorant (a dye), it is advantageous to employ a dye fixing agent, particularly a macromolecular dye fixing agent. Dye fixing agents (or macromolecular dye fixing agents) usually contain a cationic group (a particularly strongly cationic group such as guanidyl or quaternary ammonium salt groups) in the molecule. The dye fixing agent may be soluble in water.

As the dye fixing agent, there may be exemplified dicyan-series fixing agents (dicyandiamide-formaldehyde polycondensate, etc.), polyamine-series fixing agents [aliphatic polyamines such as diethylenetriamine, triethylenetetramine, dipropylenetriamine and polyallylamine, aromatic polyamines such as phenylenediamine, dicyandiamide-(poly)$C_{2-4}$ alkylenepolyamine condensates (dicyandiamide-diethylenetriamine polycondensate, etc.)], and polycation-series fixing agents. The polycation-series fixing agent includes, for example, epichlorohy-drin-di-$C_{1-4}$ alkylamine addition polymers (epichlorohy-drin-dimethylamine addtion polymer, etc.), polymers of allylamine or its salt (a polymer of polyallylamine or its hydrochloride, such as PAA-10C, PAA-HC1-3L, PAA-HC1-10L, etc., all available from Nitto Boseki Co., Ltd.), polymers of diallyl-$C_{1-4}$ alkylamine or its salt (e.g., a polymer of diallylmethylamine or its hydrochloride, such as PAS-M-1 available from Nitto Boseki Co., Ltd.), polymers of diallyl-di-$C_{1-4}$ alkylammonium salts (diallyldimethylammonium chloride polymer, e.g., PAS-H-5L, PAS-H-10L, etc. available from Nitto Boseki Co., Ltd.), copolymers of diallylamine or its salt with sulfur dioxide (diallylamine hydrochloride-sulfur dioxde copolymer, e.g., PAS-92 available from Nitto Boseki Co., Ltd.), dial-lyl-di-$C_{1-4}$ alkylammonium salt-sulfur dioxide copolymers (e.g., diallyldimethylammonium chloride-sulfur dioxide copolymer, such as PAS-A-1, PAS-A-5, PAS-A-120L, PAS-A-120A, etc. available from Nitto Boseki Co., Ltd.), copolymers of a diallyl-di-$C_{1-4}$ alkylammonium salt with diallylamine or a salt or derivative thereof (e.g., a copolymer of a diallyldimethylammonium chloride-diallylamine hydrochloride derivative, such as PAS-880 available from Nitto Boseki Co., Ltd.), polymers of diallyl-di-$C_{1-4}$ alkylammonium salts, polymers of di-$C_{1-4}$ alkylaminoethyl(meth)acrylate quaternary salts, diallyl-di-$C_{1-4}$ alkylammonium salt-acrylamide copolymers (diallyldimethylammonium chloride-acrylamide copolymer, such as PAS-J-81 available from Nitto Boseki Co., Ltd.), and amine-carboxylic acid copolymers (e.g., PAS-410 available from Nitto Boseki Co., Ltd.). These dye fixing agents can also be used independently or in a combination of two or more species.

The amount of the dye fixing agent can be selected from the range conducive to improved fixation, for example the range of about 0.1 to 40 parts by weight, preferably about 1 to 30 parts by weight, and more preferably about 2 to 20 parts by weight, on a nonvolatile matter basis, per 100 parts by weight of a resin composition comprising the cationic polymer and the hydrophilic polymer.

Where necessary, the ink imaging layer may be supplemented with other ingredients, such as an aqueous emulsion containing polymer particles (e.g., acrylic resin emulsion, ethylene-vinyl acetate copolymer emulsion, vinyl acetate-series emulsion).

To the ink imaging layer may be further added a conventional additive such as an antifoam, coatability improving agent, a thickener, a stabilizer (e.g., antioxidant, ultraviolet absorber, heat stabilizer, etc.), and an antistatic, provided that such additives are added in proportions not adversely affecting the characteristics of the ink imaging layer.

The thickness of the ink imaging layer can be selected according to the intended application and may for example be about 1 to 50 $\mu$m (e.g., 5 to 30 $\mu$m), preferably about 10-to 30 $\mu$m, and usually about 5 to 30 $\mu$m.

Being provided with the above ink imaging layer, the ink imaging sheet of the present invention features high ink absorption, high ink fixation properties and has been remarkably improved in print quality. Moreover, since the ink imaging sheet employs a stretched styrenic resin sheet as a base, its transparency is high, and the visible ray transmittance is about 85 to 95%, and usually about 88 to 90%.

Production Method

The ink imaging sheet of the present invention can be manufactured by forming, on at least one surface of the above-mentioned base sheet, an ink imaging layer containing at least the above-mentioned components.

The ink imaging layer can be formed by coating a base or support with a coating composition prepared with the use of a suitable solvent (water, a hydrophilic solvent which may be soluble in water, a hydrophobic solvent, or a mixture of these solvents). When the ink imaging layer is made from a hydrophilic polymer and a cationic polymer and the cationic polymer is in the form of an aqueous emulsion, an aqueous or water-based coating composition is employed. The coating composition is cast or coated on at least one side of the base by roll coating, air knife coating, blade coating, rod coating, bar coating, comma coating, gravure coating, silk screen coating, or other conventional casting or coating techniques.

The ink imaging layer can be provided by applying a coating composition containing the above-mentioned ingredients or components to at least one side of the base and drying the coating. Where necessary, a crosslinked ink imaging layer may be provided by heating the coated base at a suitable temperature selected from the range of about 50 to 150° C. following applying the coating composition to the base.

Where necessary, a porous layer, an antiblocking layer, a lubrication or slipping layer, or an antistatic layer may be superimposed on the ink accepting layer.

The ink imaging sheet of the present invention is not only useful as an ink imaging sheet for the ink jet recording system in which flying droplets of ink are used to make a record, but also as a printing sheet (particularly sheets for water-based ink) for off set printing, flexography or other printing methods.

In the present invention, ink absorption, ink fixation, and print quality are highly improved because an ink imaging layer comprising at least a hydrophilic copolymer is formed on at least one surface of a stretched styrenic resin sheet. In addition to such advantages, though the sheet is made of plastic, it can be easily torn or shredded by a shredder or the like. Moreover, the sheet of the present invention is advantageous as an overhead projector (OHP) sheet required to be highly transparent. Furthermore, when the ink imaging layer contains a particulate lubricant (or a powdery lubricant), loss of part of an image printed on the sheet or an incomplete image caused on contact with other sheets or hands of users, clothes, etc. (particularly loss of part of a printed image before having bee dried completely) hardly occurs, and the sheets are prevented from blocking.

EXAMPLES

The following examples are intended to illustrate the present invention in further detail and should by no means be construed as defining the scope of the invention.

In the examples, the term "part(s)" indicates part(s) by weight.

The base sheets, hydrophilic polymers, cationic polymers, and lubricants used in Examples, Comparative Examples, and Reference Examples are as follows.

1. Base sheet (a-1): stretched polystyrene sheet Daicel Chemical Industries, Ltd.; OPS sheet G90; thickness: 130 $\mu$m (a-2): polyethylene terephthalate film Dia foil Hoechst co.; T-100; thickness: 100 $\mu$m.

2. Hydrophilic polymer (b-1): polyoxyalkylene-modified polyvinyl alco-hol Nippon Synthetic Chemical Industry Co., Ltd.; OKS-7158G 3. Cationic polymer (c-1): Cationic acrylic copolymer emulsion 1

A 2,000 ml reactor equipped with a stirrer, a reflux condenser, a drip funnel, a nitrogen gas inlet pipe, and a thermometer was charged with 219 parts of isopropyl alcohol (IPA) and 1.23 parts of azoisobutyronitrile (AIBN). The charge was dissolved by stirring and heated to 80° C. As a copolymerization component, a mixture of 93.7 parts of methyl methacrylate (MMA), 98.7 parts of n-butyl acrylate (BA), 49.3 parts of diethylaminoethyl methacrylate (DEAEMA), and 4.93 parts of trimethoxysilanepropyl methacrylate (Nippon Unicar, A-174; hereinafter sometimes referred to simply as A-174) was fed dropwise into the reactor over about 4 hours. After the completion of the dropwise addition, a solution mixture of 0.25 part of AIBN and 25 parts of IPA was further added dropwise as an additional catalyst, and the reaction was continued for another 2 hours to complete the polymerization reaction.

After the completion of the polymerization, 16 parts of acetic acid was fed into the flask with constant stirring and, thereafter, 705 parts of water was introduced dropwise over about 2 hours for emulsification. From the resulting emulsion, IPA was evaporated off on a rotary evaporator to provide a cationic acrylic copolymer emulsion (c-1)(solids content: 34.7%).

(c-2) Cationic acrylic copolymer emulsion 2

Except for using, as copolymerization components, 71.6 parts of MMA, 71.6 parts of BA, 49.3 parts of DEAEMA, 49.3 parts of polyethylene glycol methacrylate (NOF Corporation, Blemmer PEG-200; hereinafter sometimes referred to simply as PEG-200), and 4.9 parts of "A-174", the procedure of (c-1) was repeated to provide a cationic acrylic copolymer emulsion (c-2) (solids content: 31.9%).

4. Lubricant (d-1): Poly methylmethacrylate particles Sekisui Kaseihin Industries, Ltd.; Techpolymer MBX-20; particle size: 20 μm (d-2): Silica particles Degusa Corporation; FK-310; particle size: 0.3 μm The characteristics of the ink imaging sheets prepared in Examples, Comparative Examples, and Reference Examples were evaluated as follows.

(Tearing Strength)

In a film of 50 mm wide×150 mm length, a 75 mm slit extending from the widthwise center point in the lengthwise direction is made to give a test specimen.

According to JIS K7128 ("A method" for testing the tearing strength of plastic films and sheets: Trousers Tearing Method), the tearing strength of the test specimen was measured using a universal tensile tester at a tensile rate of 200 mm per minute.

Using an ink jet printer (BJC-420J, manufactured by Canon, Inc.), a solid record image in each color of cyan yellow, magenta and black was printed on the recording sheet obtained in Examples and Comparative Examples.

(Ink Absorption)

At every predetermined period of time after printing, PPC copying paper was set on the printed portion and pressed against the sheet with a finger for 5 seconds. The copying paper was then removed and visually inspected for offset. The ink absorption was evaluated in terms of the time when offset was no longer observed.

(Print Quality)

The print quality was visually evaluated according to the following criteria.

○: Uniform print

Δ: Somewhat uneven print

X: Considerably uneven print (Ink fixation (water resistance))

After printing, the print was wiped with a water-soaked cotton swab in 10 reciprocations and the ink fixation (loss of part of a printed image) was evaluated according to the following criteria.

: ○: The image was hardly wiped out or blurred.

X: The image was easily wiped out or blurred.

Examples 1 and 2

In accordance with the combinations shown in Table 1, 30 parts of a cationic polymer (solids content), 700 parts of an aqueous solution containing 10% by weight of a hydrophilic polymer (solids content: 70 parts), and 1 part by weight of the particulate lubricant (d- 1) were mixed to give a water-soluble coating composition.

The water-soluble coating composition was applied on the base sheet (a-1) of 130 μm thickness, and the coating was dried at a temperature of 100° C. for three minutes to form an ink imaging sheet having an ink imaging layer of 15 μm thickness. The tearing strength of the resultant sheet, ink absorption, print quality and ink fixation were evaluated as described above. The results are shown in Table 1.

Examples 3 and 4

Except that 3 parts by weight of the silica particles (d-2) was used as a particulate lubricant, sheets were produced in the same manner as Example 1 and evaluated. The results are shown in Table 1.

Example 5

Except that 1,000 parts of an aqueous solution containing 10% by weight of a hydrophilic polymer (solids content: 100 parts) was used instead of the cationic polymer, a sheet was produced in the same manner as Example 1 and evaluated. The results are shown in Table 1.

Comparative Examples 1 and 2

Except that the polyethylene terephthalate film of 100 μm thickness (a-2) was used as a base sheet, sheets were manufactured in the same manner as Examples 1 and 2 and evaluated. The results are shown in Table 1.

Comparative Example 3

Except that 1,000 parts of an aqueous solution containing 10% by weight of a hydrophilic polymer (solids content: 100 parts) was used instead of the cationic polymer, a sheet was manufactured in the same manner as Comparative Example 1 and evaluated. The results are shown in Table 1.

Comparative Example 4

Except that the particulate lubricant was not used, a sheet was formed in the same manner as Comparative Example 1 and evaluated. The results are shown in Table 1.

Reference Example 1

For the base sheet (a-1) alone, the same evaluation procedure as conducted in Example 1 was repeated 3 times, and the tearing strength is the average of the obtained results. The results are shown in Table 1.

Reference Example 2

The base sheets (a-2) was heat-treated at a temperature of 100° C. for three minutes and evaluated in the same manner as Reference Example 1. The results are shown in Table 1.

TABLE 1

| | Base sheet | Hydrophilic polymer | Cationic polymer | Lubricant | Tearing Strength (Kgf/mm) | Ink absorption (min.) | Print quality | Ink fixation |
|---|---|---|---|---|---|---|---|---|
| Example 1 | a-1 | b-1 | C-1 | d-1 | 0.11 | 3 | ○ | ○ |
| Example 2 | a-1 | b-1 | C-2 | d-1 | 0.13 | 3 | ○ | ○ |
| Example 3 | a-1 | b-1 | C-1 | d-2 | 0.12 | 3 | ○ | ○ |
| Example 4 | a-1 | b-1 | C-2 | d-2 | 0.13 | 3 | ○ | ○ |
| Example 5 | a-1 | b-1 | — | d-1 | 0.14 | 3 | ○ | x |
| Com. Ex. 1 | a-2 | b-1 | C-1 | d-1 | 0.50 | 3 | ○ | ○ |
| Com. Ex. 2 | a-2 | b-1 | C-2 | d-1 | 0.53 | 3 | ○ | ○ |
| Com. Ex. 3 | a-2 | b-1 | — | d-1 | 0.52 | 3 | ○ | x |
| Com. Ex. 4 | a-2 | b-1 | C-1 | — | 0.50 | 5 | ○ | ○ |
| Ref. Ex. 1 | a-1 | — | — | — | 0.11 | — | — | — |
| Ref. Ex. 2 | a-2 | — | — | — | 0.55 | — | — | — |

As obvious from Table 1, the ink imaging sheets obtained in Examples had higher degrees of ink absorption and print quality compared to those obtained in Comparative Examples. Moreover, their tearing strengths were smaller and consequently they were easily shredded by a shredder. The polyethylene terephthalate films of Comparative Examples become jammed when put into a shredder and consequently shredding them was ended in failure. Besides, the ink absorption of the sheet of Comparative Example 4 containing no lubricant was degraded. Further, the writing quality of the ink imaging sheets of Examples with a water marking pen was good, and touching on what was written on the sheet with hands didn' t make it as much blurred or smeared as in the case of the polyethylene terephthalate film.

What is claimed is:

1. An ink imaging sheet comprising a base sheet and an ink imaging layer formed on at least one surface of the base sheet, wherein the base sheet is constituted of a tearable stretched styrenic resin sheet in which:

the tearing strength of said stretched styrenic resin sheet is 0.05 to 0.25 Kgf/mm;

the ratio of the tearing strength of a 130 $\mu$m-thick stretched specimen of said styrenic resin sheet ($S_{ST}$) to the tearing strength of a 100 im-thick polye thylene terephthalate film ($S_{PET}$) is $S_{ST}/S_{PET}$=0.01/1 to 0.7/1; and the draw ratios of said stretched styrenic resin sheet are 1.5 to 3 times lengthwise and 1.5 to 3 times widthwise, wherein said ink imaging layer comprises a cationic polymer comprising a cationic monomer and an alkoxysilyl group-containing crosslinking monomer, a hydrophilic polymer, and a particulate lubricant.

2. The ink imaging sheet according to claim 1, wherein the thickness of said stretched styrenic resin sheet is 30 to 500 $\mu$m.

3. The ink imaging sheet according to claim 1, wherein said cationic polymer further comprises a hydrophilic monomer.

4. The ink imaging sheet according to claim 3, wherein said hydrophilic monomer is a (meth)acrylate having a polyoxyalkylene unit.

5. The ink imaging sheet according to claim 1, wherein the mean particle size of said lubricant is 0.1 to 50 $\mu$m.

6. The ink imaging sheet according to claim 1, wherein said ink imaging layer contains 0.1 to 10 parts by weight of said lubricant relative to 100 parts by weight of the total amount of the constituting components of the ink imaging layer.

7. The ink imaging sheet according to claim 1, wherein said ink imaging layer contains 10 to 150 parts by weight of said lubricant relative to 100 parts by weight of an alkoxysilyl group-containing cationic polymer (on a monomer basis).

8. The ink imaging sheet according to claim 1, wherein:

the tearing strength of said base sheet is 0.08 to 0.2 Kgf/mm;

said ink imaging layer comprises a cationic polymer, a hydrophilic polymer, and a particulate lubricant having a mean particle size of 0.2 to 50 $\mu$m; and the proportion of the lubricant is 0.2 to 8 parts by weight relative to 100 parts by weight of the total amount of the constituting components of the ink imaging layer.

* * * * *